US007777139B2

(12) United States Patent
Mattlar et al.

(10) Patent No.: US 7,777,139 B2
(45) Date of Patent: Aug. 17, 2010

(54) SWITCHING DEVICE PROVIDED WITH NEUTRAL CONDUCTOR

(75) Inventors: Harri Mattlar, Iskmo (FI); Rainer Kolmonen, Laihia (FI); Aki Suutarinen, Vaasa (FI)

(73) Assignee: ABB Oy, Helsinki (FI)

( * ) Notice: Subject to any disclaimer, the term of this patent is extended or adjusted under 35 U.S.C. 154(b) by 797 days.

(21) Appl. No.: 10/585,353

(22) PCT Filed: Jan. 18, 2005

(86) PCT No.: PCT/FI2005/000030

§ 371 (c)(1),
(2), (4) Date: Apr. 11, 2007

(87) PCT Pub. No.: WO2005/069332

PCT Pub. Date: Jul. 28, 2005

(65) Prior Publication Data

US 2007/0272527 A1 Nov. 29, 2007

(51) Int. Cl.
*H01H 9/00* (2006.01)

(52) U.S. Cl. ..... 200/17 R

(58) Field of Classification Search ..... 200/1 R, 200/17 R, 48 R, 49, 51.09, 52 R, 334; 439/479, 439/115, 188, 189, 214, 266, 299, 296, 300, 439/310, 507, 477–481, 502, 801, 823, 826, 439/842, 848, 851

See application file for complete search history.

(56) References Cited

U.S. PATENT DOCUMENTS 1,046,465 A * 12/1912 Hoyt ..... 439/507
1,790,101 A * 1/1931 Kohloff ..... 439/502
1,928,681 A * 10/1933 Beling ..... 307/13
4,578,732 A * 3/1986 Draper et al. ..... 361/45
5,038,257 A * 8/1991 Agabekov ..... 362/219
5,061,833 A * 10/1991 Hodder et al. ..... 200/255
5,723,841 A 3/1998 Kurono
5,828,017 A * 10/1998 Fiorini et al. ..... 200/17 R
6,024,604 A * 2/2000 Chilton et al. ..... 439/579
6,252,187 B1 * 6/2001 Dannenberg ..... 200/51.14
6,486,407 B1 * 11/2002 Hawker et al. ..... 174/149 B (Continued)

FOREIGN PATENT DOCUMENTS

CN 2346056 10/1999

(Continued)

OTHER PUBLICATIONS

International Search Report dated May 25, 2005.

(Continued)

*Primary Examiner*—Michael A Friedhofer
(74) *Attorney, Agent, or Firm*—Buchanan Ingersoll & Rooney PC

(57) ABSTRACT

A switching device is disclosed which includes a neutral conductor and arranged for opening and closing an electric circuit. The switching device includes a frame, through which the electric circuit's neutral conductor having a first end and a second end passes. The neutral conductor includes a movable middle portion that is arranged for breaking the neutral conductor inside the frame, the movable middle portion being movable with respect to the first and the second end of the neutral conductor and located between them.

18 Claims, 1 Drawing Sheet

U.S. PATENT DOCUMENTS

| | | | | |
|---|---|---|---|---|
| 6,660,950 | B2 * | 12/2003 | Fonseca | 200/51 R |
| 6,817,877 | B1 * | 11/2004 | Agabekov et al. | 439/207 |

FOREIGN PATENT DOCUMENTS

| | | | |
|---|---|---|---|
| CN | 2483820 | | 3/2002 |
| DE | 43 12 594 | A1 | 10/1994 |
| EP | 0 599 800 | A1 | 6/1994 |
| EP | 0 884 747 | A2 | 12/1998 |
| EP | 1 146 534 | A1 | 10/2001 |
| JP | 9-092066 | A1 | 4/1997 |

OTHER PUBLICATIONS

Written Opinion of the International Searching Authority dated May 25, 2005.
Finland Search Report dated Nov. 30, 2004dated Dec. 7, 2004 (with English translation of category of cited documents).
English Translation of Chinese Office Action issued in Patent Application No. 200580002758.8 dated Dec. 5, 2008.

* cited by examiner

SWITCHING DEVICE PROVIDED WITH NEUTRAL CONDUCTOR

BACKGROUND OF THE INVENTION

The invention relates to a switching device provided with a neutral conductor.

Switching devices are apparatuses that are used for opening and closing an electric circuit. A switching device comprises at least one pole connected to a phase conductor and a control device for opening and closing this pole. Examples of switching devices are switches and switch fuses.

It is known to arrange a neutral conductor to pass through a switching device.

In some situations, for example when a switching device is installed or serviced, it is necessary to perform measurements or tests where the influence of the neutral conductor has been eliminated. Breaking the neutral conductor may be required in connection with an insulation level measurement, for instance. In prior art switching devices, however, the breaking of a neutral conductor is often difficult, or the structure of the breaking mechanism is complex.

BRIEF DESCRIPTION OF THE INVENTION

The object of the invention is to provide a switching device provided with a neutral conductor to solve the above-mentioned problems. The object of the invention is achieved by a switching device which is characterized by features of the disclosure. Additional embodiments of the invention are also disclosed.

The invention is based on the neutral conductor comprising a movable middle portion for breaking the neutral conductor.

An advantage of the switching device according to the invention is that the neutral conductor can be broken quickly and easily for measurements or testing, for example. A further advantage is that the structure of the breaking mechanism is simple.

BRIEF DESCRIPTION OF THE FIGURES

The invention will now be described in greater detail by means of preferred embodiments, with reference to the accompanying drawings, in which.

DETAILED DESCRIPTION OF THE INVENTION

Figure 1:
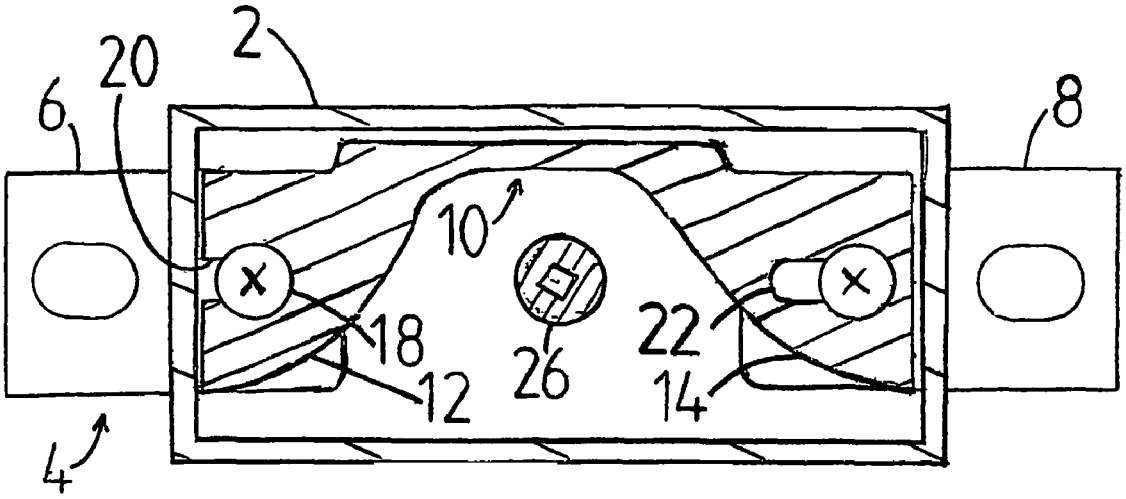
FIG. 1 is a top view of a partly dismantled control device module of a switching device according to an embodiment of the invention.

In the control device module of FIG. 1, a neutral conductor 4, which is arranged to be broken, passes through a frame 2. The neutral conductor 4 comprises a first end 6, a second end 8 and a movable middle portion 10.

The first end 6 of the neutral conductor 4 is close to the first side of the frame 2 and the second end 8 of the neutral conductor 4 is close to the second side of the frame 2. The first and the second side of the frame are opposite to each other. The movable middle portion 10 of the neutral conductor can be moved with respect to the first 6 and the second 8 end of the neutral conductor 4, and it is located between them so that the first end 12 of the movable middle portion 10 is close to the first end 6 of the neutral conductor 4 and the second end 14 of the movable middle portion 10 is close to the second end 8 of the neutral conductor 4.

Both the first 6 and the second 8 end of the neutral conductor are formed of a substantially rectangular planar preform by bending it so as to provide it with a cross-sectional shape that resembles the letter U, where one of the branches of the letter U is longer than the other. The longer branch extends outside the frame 2 and is arranged to be connected to the neutral wire of the electric circuit or to another similar structure. The first 6 and the second 8 end are arranged so that the longer branch of the letter U is located lower than the shorter branch.

The movable middle portion 10 of the neutral conductor is formed of a planar preform by bending the middle portion of the preform so that it is at a right-angle towards the rest of the preform. Thus the middle portion of the preform forms portion 24 which is at an angle of 90° with respect to the plane in which the first 12 and the second 14 end of the movable middle portion 10 are located.

The portion 24 of the movable middle portion 10 is in a different plane than the ends of the middle portion 10 since a control shaft 26 of the switching device passes in the middle of the frame 2, the control shaft being arranged to control the switching device. The bent structure of the movable middle portion 10 thus improves space utilization inside the frame 2. In addition to the movable middle portion 10, attention is preferably paid to space utilization in the design of the first 6 and the second 8 end of the neutral conductor 4, too, i.e. to the arrangement of other components inside the frame 2 as well as to their easy installation. The components to be mounted inside the frame 2, which are preferably taken into account in the shaping of the neutral conductor 4, include auxiliary contacts and microswitches and the main shaft of the switching device. These components are not shown in the figures.

The parts of the neutral conductor 4 are shaped to enable the portion 24 to slide to the side of the second end 8 of the neutral conductor, whereby the portion 24 is partly between the second end 8 of the neutral conductor and the frame 2 wall.

When the first end 6 of the neutral conductor 4 is desired to be in contact with the second end 8 of the neutral conductor 4, the movable middle portion 10 is pressed against the first 6 and the second end 8 by pressing means 16. The pressing means 16 comprise one screw member 18 per each end of the movable middle portion 10. Each screw member 18 comprises a threaded portion and a head portion, the diameter of the head portion being larger than that of the threaded portion. The lower surfaces of the head portions of the screw members 18 are arranged to press the movable middle portion 10 against the first 6 and the second 8 end of the neutral conductor when the screw members are tightened.

The materials of the neutral conductor 4 and pressing means 16 have been selected and dimensioned to correspond to the currents passing in the neutral conductor.

Figure 2:
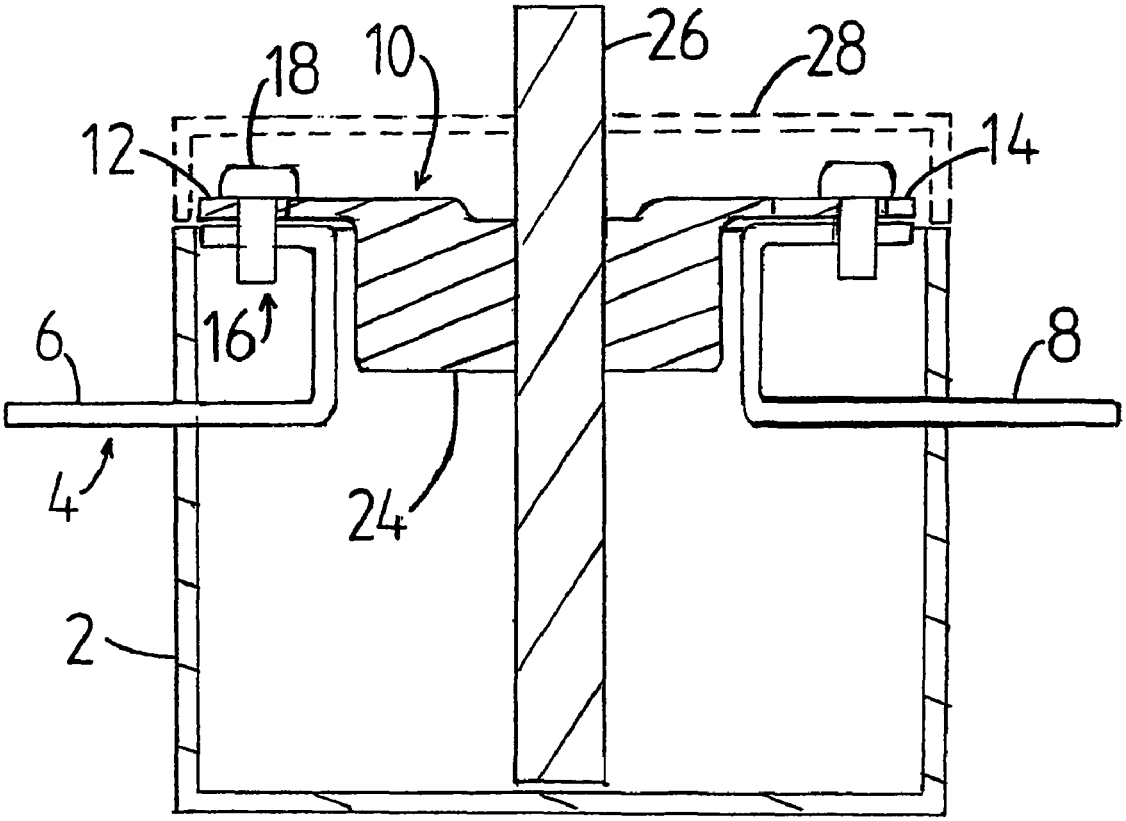
FIG. 2 is a cross-sectional side view of the control device module of FIG. 1.

In the structure illustrated in FIG. 2, the counterparts for the screw members 18 are integrated into the first 6 and the second 8 end of the neutral conductor 4, i.e. the ends are provided with threads that are arranged to cooperate with the respective threaded portion of the screw member 18. Alternatively, separate nuts can be employed.

The movability of the middle portion 10 is achieved by two slots. At the first end 12 of the movable middle portion 10, there is an open slot 20, and at the second end 14 a closed slot 22. The open slot 20 has one open end and one closed end. The both ends of the closed slot 22 are closed. The slots 20 and 22 are arranged to receive the threaded portion of the respective screw member 18. Each slot forms an opening extending through the middle portion 10 so that the threaded portion of the respective screw member 18 may pass through the movable middle portion 10 via the slot. The threaded portion of the screw member 18 can be slid through the open end of the open slot 20, whereas each closed end of the slots prevents sliding the threaded portion therethrough.

The width of both the open slot 20 and the closed slot 22 is slightly larger than the diameter of the respective screw member and smaller than the diameter of the head portion. In the direction perpendicular to the longitudinal axis of the screw member 18, the length of the slots 20 and 22 is greater than the diameter of the screw member 18. The closed slot 22 is substantially longer than the open slot 20.

The first end 12 of the movable middle portion 10 is detachable from the first end 6 of the neutral conductor without removing the respective screw member 18. When the respective screw member 18 has been loosened by turning it a bit in the opening direction, the first end 12 of the movable middle portion 10 can be slid away from below the head of the screw member 18. The second end 14 of the movable middle portion 10 cannot be fully detached from the second end 8 of the neutral conductor without removing the respective screw member 18.

In a preferred embodiment of the invention, the closed slot 22 is made so long that the movable middle portion 10 can be slid, without removing the respective screw member 18 of the closed slot 22, into a position where the middle portion 10 is not in a conductive contact with the first end 6 of the neutral conductor 4 even though the respective screw member 18 of the closed slot 22 were retightened. The neutral conductor 4 is thus broken by loosening the screw members 18 and by sliding the movable middle portion 10 along the upper surface of the first 6 and the second 8 end of the neutral conductor towards the second end 8 of the neutral conductor. By tightening the screw member 18 at the second end 8, the movable middle portion 10 can be locked in a desired position, in which case it cannot accidentally move into a conductive contact with the first end 6 of the neutral conductor. An advantage of this embodiment is that the conductive contact between the ends 6 and 8 of the neutral conductor 4 can be reliably maintained broken during measurements or testing without having to detach any part of the neutral conductor 4 or the pressing means 16 from the switching device. As a result, none of the parts of the neutral conductor 4 or pressing means is at the risk of disappearing during the measurement or testing.

In an alternative embodiment, both ends of the movable middle portion 10 comprise a slot having an open end. In that case, the slots can be adapted such that the movable middle portion 10 can be detached from the switching device after the screw members 18 have been loosened, i.e. neither of the screw member 18 needs to be completely removed for detaching the movable middle portion 10.

In FIG. 2, the dashed line illustrates a lid 28 that covers the neutral conductor 4 during the normal use of the switching device. The lid 28 is quickly detachable and attachable for easy access to the neutral conductor 4. In an embodiment, the lid 28 is arranged to be openable without tools.

The switching device structure according to the invention, which comprises a neutral conductor that can be broken, was described above in connection with a modular switching device. It is clear that the structure according to the invention is also applicable to switching devices where the control apparatus is mounted in the same frame part with the switch poles.

It is obvious to a person skilled in the art that the inventive concept can be implemented in various ways. The invention and its embodiments are thus not limited to the above examples but they may vary within the scope of the claims.

The invention claimed is:

1. A switching device for opening and closing an electric circuit, the switching device comprising:

a neutral conductor having a first end and a second end; and a frame through which the neutral conductor is configured to pass, wherein the neutral conductor comprises a movable middle portion that is arranged for breaking the neutral conductor inside the frame, wherein the movable middle portion has a first end and a second end, is movable with respect to the first and second ends of the neutral conductor, and is located between the first and second ends of the neutral conductor, wherein the switching device further comprises pressing means for pressing the movable middle portion against the first and second ends of the neutral conductor, wherein the pressing means comprise:

a first screw member for the first end of the movable middle portion; and a second screw member for the second end of the movable middle portion, wherein the first and second screw members each comprise a threaded portion and a head portion, and wherein, for each one of the first and second screw members, a diameter of the head portion is larger than a diameter of the threaded portion.

2. A switching device according to claim 1, wherein the movable middle portion comprises a first slot at the first end of the middle movable portion and a second slot at the second end of the middle movable portion, wherein each slot forms a corresponding opening extending through the middle portion, and wherein the threaded portions of the first and second screw members are arranged to pass through the movable middle portion via the first and second slots, respectively.

3. A switching device according to claim 2, wherein an end of the first slot at the first end of the movable middle portion is open.

4. A switching device according to claim 3, wherein the second slot at the second end of the movable middle portion has a length to enable the neutral conductor to be broken by loosening the screw members and by sliding the movable middle portion along respective surfaces of the first and second ends of the neutral conductor towards the second end of the neutral conductor until the movable middle portion reaches a position where the movable middle portion is not in a conductive contact with the first end of the neutral conductor.

5. A switching device according to claim 4, wherein the movable middle portion comprises a portion which is in a substantially perpendicular plane with respect to a plane in which the first and the second end of the movable middle portion are located.

6. A switching device according to claim 4, wherein the switching device is a modular switching device, and wherein the neutral conductor is comprised in a control device module.

7. A switching device according to claim 3, wherein the movable middle portion comprises a portion which is in a substantially perpendicular plane with respect to a plane in which the first and the second end of the movable middle portion are located.

8. A switching device according to claim 3, wherein the switching device is a modular switching device, and wherein the neutral conductor is comprised in a control device module.

9. A switching device according to claim 2, wherein the movable middle portion comprises a portion which is in a substantially perpendicular plane with respect to a plane in which the first and the second end of the movable middle portion are located.

10. A switching device according to claim 2, wherein the switching device is a modular switching device, and wherein the neutral conductor is comprised in a control device module.

11. A switching device according to claim 1, wherein the movable middle portion comprises a portion which is in a substantially perpendicular plane with respect to a plane in which the first and the second end of the movable middle portion are located.

12. A switching device according to claim 2, wherein the switching device is a modular switching device, and wherein the neutral conductor is comprised in a control device module.

13. A switching device for opening and closing an electric circuit, the switching device comprising:

a neutral conductor having a first end and a second end; and a frame through which the neutral conductor is configured to pass, wherein the neutral conductor comprises a movable middle portion that is arranged for breaking the neutral conductor inside the frame, wherein the movable middle portion has a first end and a second end, is movable with respect to the first and second ends of the neutral conductor, and is located between the first and second ends of the neutral conductor, and wherein the movable middle portion comprises a portion which is in a substantially perpendicular plane with respect to a plane in which the first and the second end of the movable middle portion are located.

14. A switching device according to claim 13, comprising pressing means for pressing the movable middle portion against the first and second ends of the neutral conductor.

15. A switching device according to claim 13, wherein the switching device is a modular switching device, and wherein the neutral conductor is comprised in a control device module.

16. A switching device according to claim 13, comprising a pressing mechanism configured to press the movable middle portion against the first and second ends of the neutral conductor.

17. A switching device for opening and closing an electric circuit, the switching device comprising:

a neutral conductor having a first end and a second end; and a frame through which the neutral conductor is configured to pass, wherein the neutral conductor comprises a movable middle portion that is arranged for breaking the neutral conductor inside the frame, wherein the movable middle portion has a first end and a second end, is movable with respect to the first and the second ends of the neutral conductor, and is located between the first and second ends of the neutral conductor, wherein the switching device further comprises a pressing mechanism configured to press the movable middle portion against the first and second ends of the neutral conductor, wherein the pressing mechanism comprises:

a first screw member for the first end of the movable middle portion; and a second screw member for the second end of the movable middle portion, wherein the first and second screw members each comprise a threaded portion and a head portion, and wherein, for each one of the first and second screw members, a length of the head portion is larger than a diameter of the threaded portion.

18. A switching device according to claim 17, wherein the corresponding head portions of the first and second screw members each have a circular cross-section, and wherein each length of the corresponding head portion is a diameter of the circular cross-section, respectively.

* * * * *

UNITED STATES PATENT AND TRADEMARK OFFICE

CERTIFICATE OF CORRECTION

PATENT NO. : 7,777,139 B2
APPLICATION NO. : 10/585353
DATED : August 17, 2010
INVENTOR(S) : Harri Mattlar et al.

It is certified that error appears in the above-identified patent and that said Letters Patent is hereby corrected as shown below:

On the front page of the Letters Patent, Item (30) Foreign Application Priority Data, please add:

Item (30) Foreign Application Priority Data

--Jan. 19, 2004 (FI).....20040072--.

Signed and Sealed this

Seventh Day of December, 2010

David J. Kappos

David J. Kappos
*Director of the United States Patent and Trademark Office*